United States Patent [19]

Ishikawa et al.

[11] Patent Number: 4,946,417

[45] Date of Patent: Aug. 7, 1990

[54] RUNNING TOY SHOOTING APPARATUS

[75] Inventors: Ichiro Ishikawa; Hiroyoshi Kamei, both of Tokyo, Japan

[73] Assignee: Sente Creations Co., Ltd., Tokyo, Japan

[21] Appl. No.: 395,465

[22] Filed: Aug. 18, 1989

[30] Foreign Application Priority Data

Jul. 4, 1989 [JP] Japan ..... 1-79471[U]

[51] Int. Cl.[5] ..... A63H 29/00; A63H 29/20; A63H 17/21

[52] U.S. Cl. ..... 446/430; 446/440

[58] Field of Search ..... 446/430, 429, 462, 463, 446/440; 273/86 R

[56] References Cited

U.S. PATENT DOCUMENTS

| | | | |
|---|---|---|---|
| 2,788,613 | 4/1957 | Gelfand et al. | 446/429 |
| 3,621,607 | 11/1971 | Morrison et al. | 446/462 X |
| 4,475,618 | 10/1984 | Kennedy et al. | 446/463 X |
| 4,483,096 | 11/1984 | Gabler et al. | 446/430 |
| 4,526,554 | 7/1985 | Goldfarb et al. | 446/429 |
| 4,732,569 | 3/1988 | Hippely et al. | 446/430 |

OTHER PUBLICATIONS

Japanese Utility Model Registration Application Kakai (Laid open) No. 58-80294, 1983.

*Primary Examiner*—Mickey Yu

*Attorney, Agent, or Firm*—Waldron & Associates

[57] ABSTRACT

A running toy shooting apparatus having a toy holder which holds a running toy having a flywheel as drive wheel and is movable between a starting position and a shooting position located in front of the starting position, a spring for driving the toy holder up to the shooting position, a stopper for retaining the running toy held by the holder means, a releasing means for releasing the running toy from the stopper to move the toy holder to the shooting position by the spring, and an energizer for energizing the flywheel of the running toy at the starting position.

8 Claims, 7 Drawing Sheets

RUNNING TOY SHOOTING APPARATUS

BACKGROUND OF THE INVENTION

1. Field of the Invention

The present invention relates to a running toy shooting apparatus, and more specifically it relates to a shooting apparatus by which a running toy, having a flywheel as drive wheel for running, can be stably propelled in a fixed direction with a high initial velocity.

2. Prior Art

As a method to run a running toy using a flywheel as a drive wheel shaped as a motor bicycle, a car or the like, there has hitherto been known a method of turning a flywheel by engaging a rack belt with a pinion attached to a shaft of the flywheel and pulling up the belt {Japanese Utility Model Registration Application Kokai (Laid-Open) No. 80,294/83}.

In such an method, an high initial velocity, however, cannot be obtained because considerable flywheel energy is lost by idle run time before the toy can be set on the floor, and in accelerating the toy from a stationary starting position when flywheel is put on a floor surface and starts to run. On the other hand, in order to conserve flywheel energy, if the energized running toy is pushed ahead strongly by hand, there are troubles such as lack in safety, for example, the running toy may start running in an unexpected direction or falls down.

SUMMARY OF THE INVENTION

An object of the present invention is to provide a running toy shooting apparatus which can shoot a running toy having a flywheel as drive wheel without idle run and with a high initial velocity in a desired fixed direction.

According to the present invention, there is provided a running toy shooting apparatus comprising a toy holder means which holds a running toy having a flywheel as drive wheel and moves between a starting position and a shooting position located in front of the starting position, a drive means for driving the toy holder means up to the shooting position, a stopper means for retaining the running toy held by the holder means to keep it in a stationary state, a releasing means for releasing the running toy from the stopper means to move the toy holder means to the shooting position by the drive means, and energizing means for energizing the flywheel of the running toy at the starting position.

In the running toy shooting apparatus of the present invention, the stopper means desirably comprises hooks for engaging the running toy at the starting position, thereby the running toy and the toy holder means are held and kept at the starting position. Further, the releasing means desirably comprises a manually operable member to move the hooks of the stopper means in the direction to release the engagement with the running toy.

In the present invention, the energizing means desirably comprises a gear train including a movable gear which can be moved between a position where the movable gear is engaged with a pinion rotating as one body with the flywheel of the running toy and a position apart from the pinion, a spring for pulling the movable gear toward the position apart from the pinion, a drive gear engaging with the movable gear, and a reel rotatable with the drive gear, which is constituted so as to move the movable gear to the above-mentioned position where the movable gear is engaged with the pinion to energize the flywheel by pulling out a string wound round the reel to rotate the reel.

The energizing means may also be a straight flexible rack belt engagable with the pinion rotating as one body with the flywheel of the running toy.

Moreover, in the running toy shooting apparatus of the present invention, a projection is disposed in front of the above-mentioned shooting position so as to appear or disappear according to one's will and is constitued so that a running toy, which starts running, hits the projection if it is extended, thereby the running toy can be caused to jump up, somersaulted and run again.

According to the present invention, a running toy can be set in motion keeping a stable posture by engaging with the holder member and stopper member, and energized as it is in this condition and shot immediately. When it is shot, the holder member pushes the running toy by means of the drive means, so a high initial velocity can be obtained with a minimum of idle rotation of the flywheel. Further, as the running toy starts running with keeping a stable posture, so a high running stability and a high direction stability can be obtained.

Moreover, when a projection is disposed on the runway, the running toy can be caused to jump up, somersaulted and run again.

THE PREFERRED EMBODIMENT OF THE INVENTION

Figure 1:
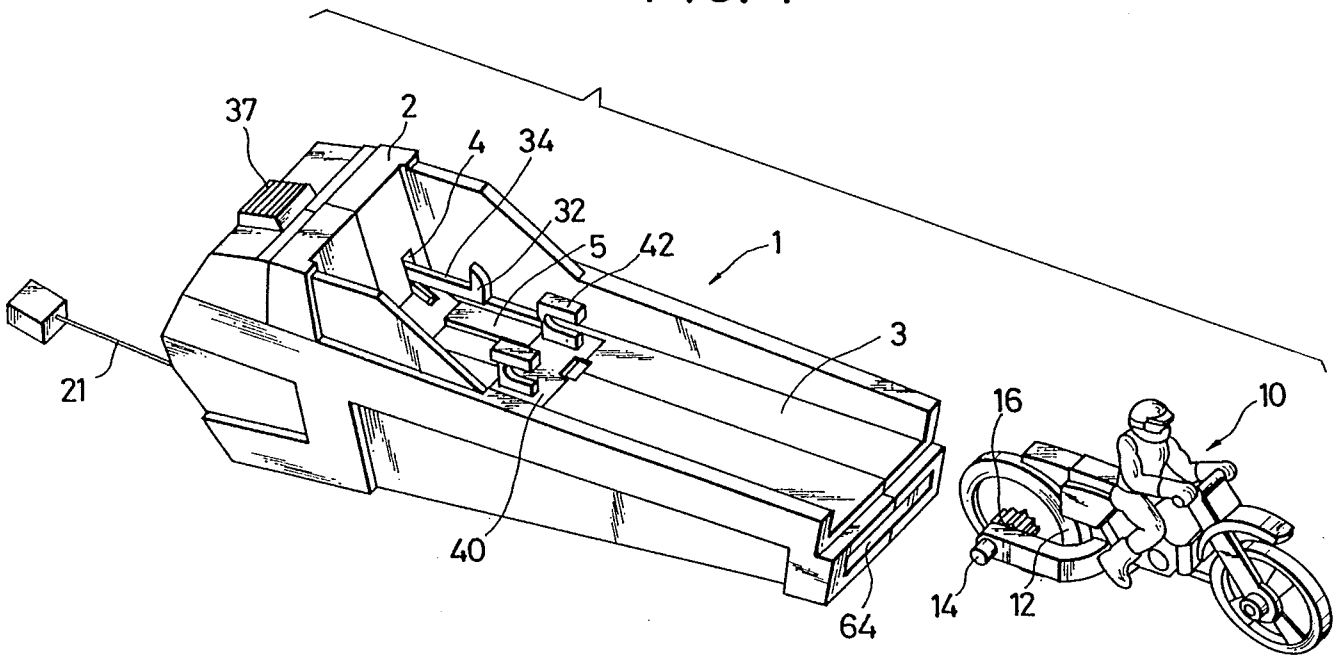
FIG. 1 is a perspective view showing an appearance of an embodiment of the present invention.
Figure 2:
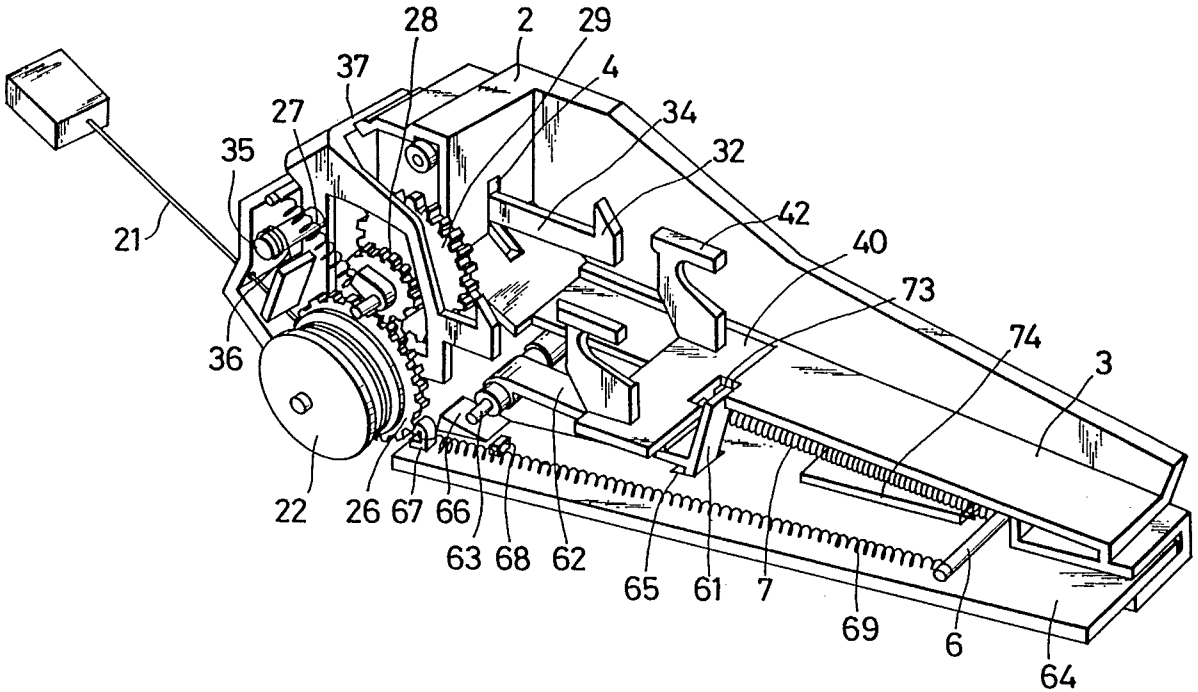
FIGS. 2 and 3 are explanation views showing inner structures of the embodiment of FIG. 1.
Figure 3:
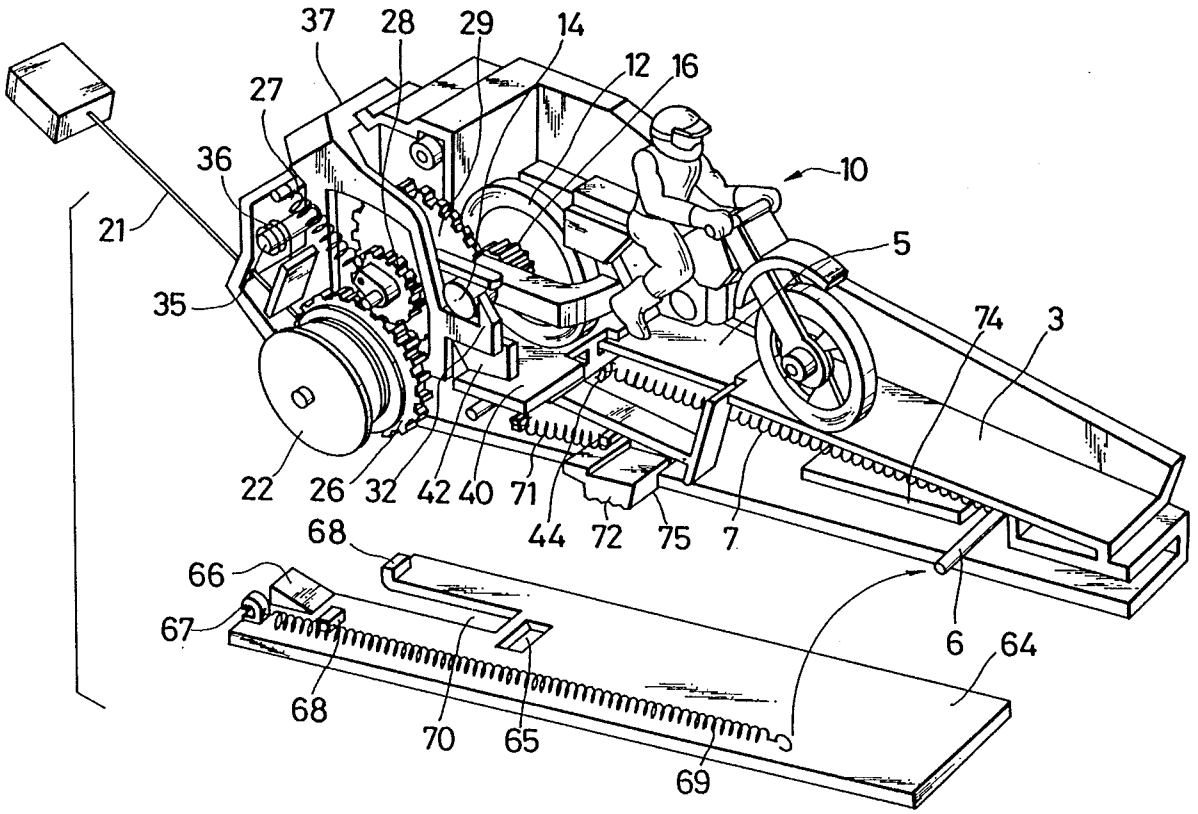

FIG. 1 is a perspective view showing an appearance of an embodiment of the present invention, FIG. 2 is an explanationn view showing an inner structure of the example of FIG. 1 and FIG. 3 is an explanation view showing the inner structure under the conditions that a running toy, having a shape of a motorcycle, is set at starting position and its flywheel is energized.

A running toy shooting apparatus 1 has an energizing mechanism 20 (shown in FIG. 5) for energizing a flywheel 12 of a running toy 10 and a shooting mechanism 30 (shown in FIG. 4) having stopper and stopper releasing functions for the running toy 10 accommodated in a housing 2 at its rear portion, a holder member 40 for holding the running toy 10 disposed in front of the above-mentioned portion, and a runway 3 formed at the front portion of the housing 2.

The housing 2 has a right and left pair of cutouts 4 cut through the front wall of the portion where the shooting mechanism 30 is accommodated. A pair of arms 34 having upward hooks 32 at their tops are extended horizontally forwards in parallel through the cutouts 4, respectively. The housing 2 has a pair of guides 5 disposed horizonally and parallel in back and forth direction at the intermediate portion. The holder member 40 has a fallen H-formed structure which can pinch the pair of the guides and are attached to the pair of the guides slidably back and forth. The holder member 40 has on its upper surface a pair of projections 42 each having a recess opened on the forward face so as to engage with a axle 14 of the flywheel 12.

In the housing 2, a crossbar 6 is disposed under the runway 3. A coil spring 7 is attached between the crossbar 6 and a hook 44 provided on the lower surface (shown in FIG. 3) of the holder member 40. The holder member 40 is pulled to the forward shooting position due to the restoring force of the coil spring 7. However, when the projections 42 are pushed backwards, the holder member 40 can slid along the pair of guides 5 and moved to the starting position behind the upward hooks 32.

Figure 4:
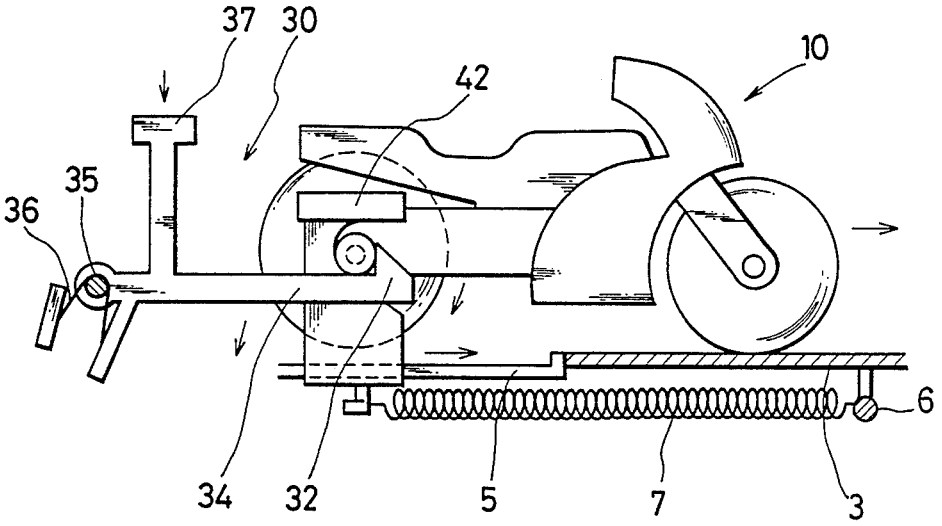
FIG. 4 is an explanation view theoretically illustrating a shooting mechanism of the embodiment of FIG. 1.

As theoretically illustrated in FIG. 4, the shooting mechanism has an pin 35 at the opposite end to the upward hooks 32 of the pair of arms 34, to which a single loop spring 36 is attached, and has a push button 37 disposed at an intermediate portion between the arms 34 and the pin 35. The arms 34 are usually maintained horizontally due to restoring force of the single loop spring 36. However, when the push button 37 is pushed, the arms 34 can be moved rotatively downwards.

When the axle 14 of the flywheel 12 of the running toy 10 is engaged with the recesses of the projections 42 of the holder member 40 and the running toy 10 is pushed backward by hand to engage the upward hooks 32, the axle shaft 14 is blocked on the front side by the upward hooks 32, thereby the running toy 10 be in a stationary condition if it is let go from the hand. Under this condition, the push button 37 is pushed by a finger to move the arms 34 downwards, thereby the upward hooks 32 are released from the shaft 14 of the flywheel 12. As a result, the holder member 40 is quickly propelled from the starting position to the forward shooting position due to the restoring force of the coil spring 7 attached to the lower surface of the holder member 40 to push out and propel the running toy 10 forwards. When the push button 37 becomes free from the finger, the arms 34 are returned into the usual horizontal state due to restoring force of the single loop spring 36.

The running toy 10 is engerized in the stationary state by the energizing mechanism 20 via the pinion 16 formed as one body with the flywheel 12.

Figure 5:
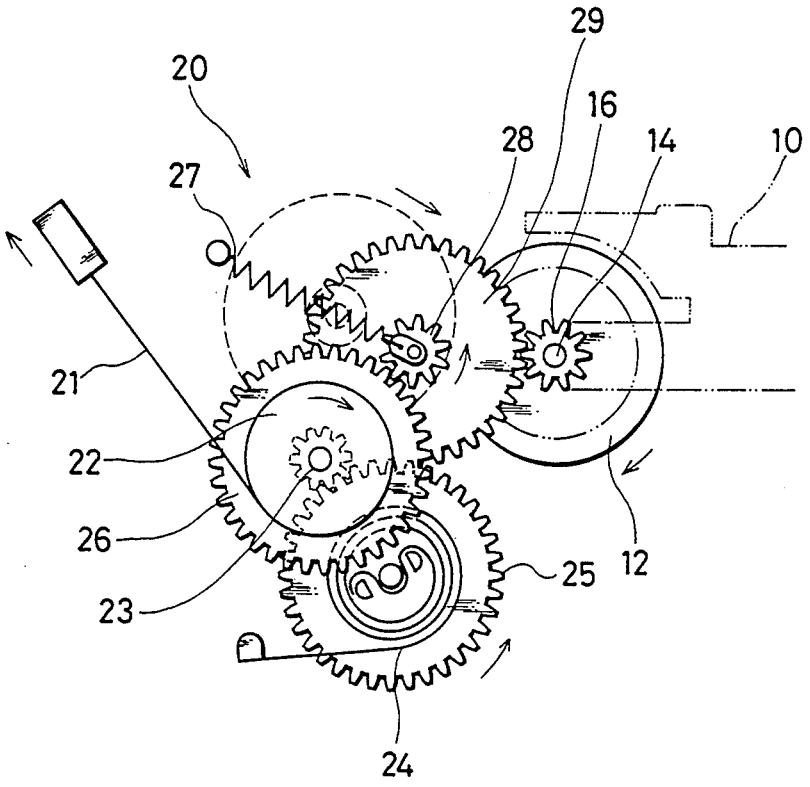
FIG. 5 is an explanation view showing an energizing mechanism of the embodiment of FIG. 1.

The energizing mechanism 20 comprises, as theoretically shown in FIG. 5, a gear train including a reel 22 having a string 21 wound therearound, a pinion 23 rotatable as one body with the reel 22, a gear 25 engaged with the pinion 23 to wind closely a power spring 24, a drive gear 26 engaged with the reel 22 by a clutch mechanism, a pinion 28 supported by a coil spring 27 and engaged with the drive gear 26, and a movable gear 29 formed as one body with the pinion 28.

When the string 21 is pulled, the reel 22 is turned clockwise in the drawing. The pinion 23, rotating as one body with the reel 22, is engaged with the gear 25 attached with the power spring 24 to turn the gear 25 counter-clockwise and wind the power spring 24 closely.

The drive gear 26, which is engaged with the reel 22 via the clutch mechanism 50 explained below (FIG. 6), is turned clockwise when the string 21 is pulled. The drive gear 26 is engaged with the movable pinion 28 which is attached rotatably to an axle pulled by a coil spring 27. When the drive gear 26 is turned clockwise, the pinion 28 is turned counter-clockwise, moving against pulling force of the coil spring 27. At this time, the movable gear 29 turning as one body with the pinion 28 moves to engage with a pinion 16 turning as one body with the flywheel 12. When the movable gear 29 is turned counter-clockwise, the pinion 16 is turned clockwise to energize the flywheel 12.

When the string is free from the pulling force, the power spring 24 becomes loose due to it own restoring force to turn the gear 25, formed as one body with the power spring 24, clockwise. Consequently, the pinion 23, engaged with the gear 25, is turned counter-clockwise and the reel 22 turning as one body with the pinion 23, is also turned counter-clockwise to rewind the string 21 round the reel 22.

The drive gear 26 is not turned because of disengagement of the clutch mechanism 50 between the drive gear 26 and the reel 22.

The pinion 28, engaged with the drive gear 26 is moved, returning to the original position due to restoring force of the coil spring 27. The movable gear 29, formed as one body with the pinion 28, is disengaged from the pinion 16 to return to the original position. The flywheel 12 is energized by above-mentioned energizing mechanism 20.

Figure 6A:
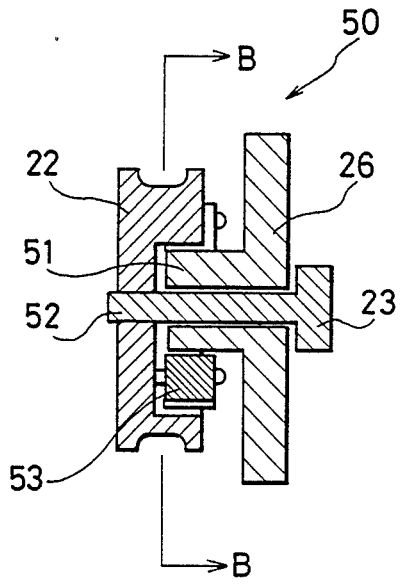
FIGS. 6(A) and 6(B) are explanation views showing a relation of a reel with a drive gear of the energizing mechanism of the FIG. 5.
Figure 6B:
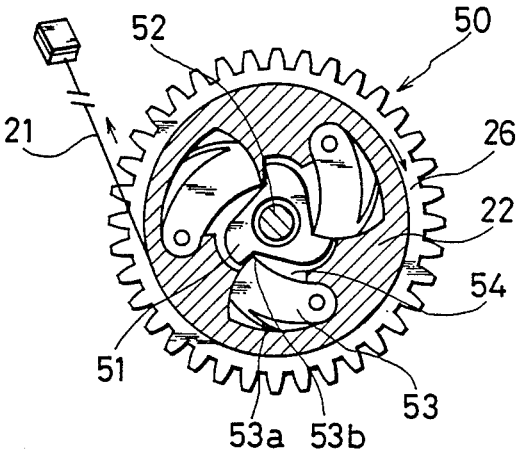

Next, the clutch mechanism 50 is explained referring to FIGS. 6(A) and 6(B).

The drive gear 26 is formed as one body with a cam 51 and attached freely rotatively to a shaft 52. The shaft 52 is fixed with the pinion 23 at one end and the reel 22 at the other end.

The reel 22 has a recess 54 positioned at the central portion. The recess 54 is shaped so that the cam 51 is fitted in the center and around the cam 51, engaged three stopper leaves 53 pivoted thereagainst. Each stopper leaf 53 has a spring portion **53*a* extending with a sharp angle from the ouside end, and the spring portion 53*a* is abutted on the circumferential wall of the recess 54 to push the stopper leaf 53 radially inward. The inside end 53*b* of the stopper leaf 53 is engaged with an edge of the cam 51**.

As the reel 22 and drive gear 26 have the relation mentioned above, when the string 21 is pulled and the reel 22 is turned clockwise, the three edges of the cam 51 are engaged with the inside ends of the three stopper leaves, respectively, so that the cam is turned clockwise and the drive gear 26, formed as one body with the cam 51, is turned clockwise. On the other hand, when the power spring 24 closely wound becomes loose, the gear 25 is turned clockwise and the pinion 23 engaging with the gear 25 is turned counter-clockwise. Though the reel 22 turning with the same shaft as the pinion 23, is turned counter-clockwise, the end portions **53*b* of the stopper leaves 53 are not engaged with the three edges of the cam 51 but are pushed onto the inner circumferential wall of the recess 54 to allow free rotation of the cam 51. Accordingly, the drive gear 26** is not turned.

By such a clutch mechanism, when the string 21 is pulled, both of the reel 21 and the drive 26 are turned, while, when the power spring 24 becomes loose, only the reel 22 is turned to wind up the string.

As the running toy shooting apparatas of the present invention is constituted as above, when the running toy 10 having a flywheel 12 as drive wheel is shot, the shaft of the flywheel 12 is engaged with the recesses of the projections 42 of the holder member 40 and pushed by hand backward up to behind the upward hooks 32 to engage the shaft with the upward hooks. Thereby the running toy 10 is made in a stationary state. Then, by pulling the string 21, the flywheel 12 is energized. Subsequently, the shooting button 37 is pushed by a finger. The upwárd hooks 32 are moved downwards rotatively to release the engagement with both the running toy 10 and the holder member 40. Accordingly, the holder member 40 is moved forwards due to restoring force of the coil spring 7, and the running toy 10 starts running forwards due to rotation of the flywheel 12. At this time, the forward movement of the holder member 40, and a high rotation of the flywheel 12, are effected each other to obtain an initial velocity much higher than hitherto realized. Further, an excellent direction stability can also be obtained by shooting with horizontal movement of the holder member 42 from a stable stationary state. Accordingly, the running toy can be shot in a desired direction.

Figure 7:
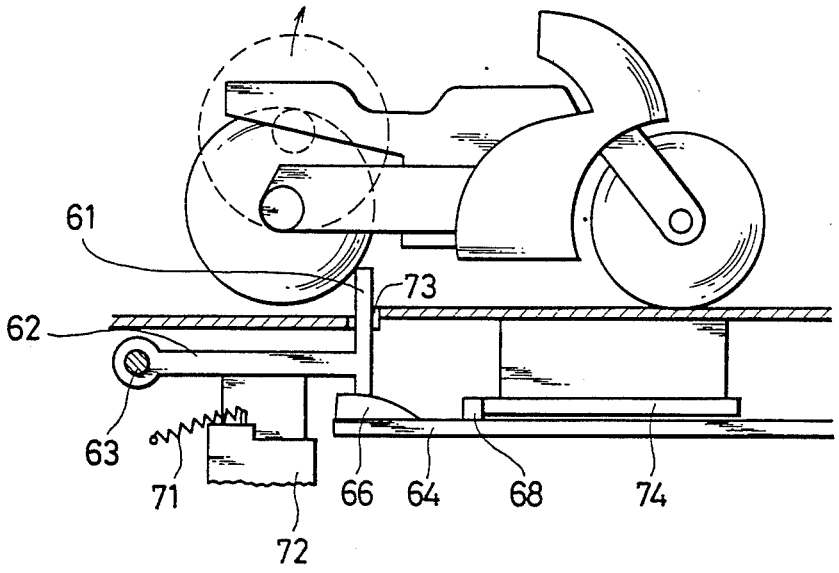
FIG. 7 is an explanation view showing a means for extending a projection within a runway of the embodiment of FIG. 1.

If a projection is disposed on the runway, the running toy can be somersaulted and run again in a high probability. A means to extend a projection is provided in the embodiment of FIGS. 2, 3 and 7.

In this embodiment, a projection 61 is provided so as to freely appear and disappear. That is, the projection 61 is formed at one end of a lever 62 to make the lever 62 and projection 61 into a T-shape. The lever 62 is supported freely rotatively at the other end with axle 63, which is supported at both side walls of inside of the housing 2. Cutouts are provided at the rear end of the runway 3 and at the center of the front end of the holder member 40 to form an opening 73 so that when the holder member is at the shooting position, the projection can be extruded through the opening 73.

On the other hand, a movable board 64 is accommodated in the bottom portion of the housing 2. The movable board is cut out at the rear portion to form an opening 65. Normally the lower part of the projection 61 is fallen down into the opening 65. In this state, the projection 61 does not appear on the runway 3. The movable board 64 is provided with an abutting part 66 having a side view of a triangle and a hook 67 at the rear end, and in front a right and left pair of stoppers 68. Between the hook 67 and the crossbar 6 provided at the front underside of the runway 3, a coil spring 69 is attached. The movable board 64 has a cutout 70 from the rear end to near the opening 65. A push button 72 formed as one body with the lever 62, is fitted into the cutout 65. The push button 72 is pulled by a spring 71 making a support of an axle 63 so as to extend downwards through the opening 75 cut through the bottom of the housing 2.

Next, a mechanism for extruding the projection 61 onto the runway 3 and moving back the same is explained.

When the push button 72, extending from the bottom surface of the housing 2 is pushed by a finger, the lever 62 is moved rotatively upwards and hence the lower portion of the projection 61 is disengaged from the opening 65 of the movable board 64 and moved upwards to extend upwards through the opening 73 of the runway 3. Disengagement of the lower portion of the projection 61 from the opening 65. Causes a forward movement of the movable board 64 due to restoring force of the coil spring 69. This movement is stopped at the position where the abutting part 66 abuts on the lower end of the projection 61 and the pair of the stoppers 68 abut on a stopper board 74 disposed under the runway 3. Consequently, the projection 61 can be kept in an extended state.

For returning the projection 61 into the unextended original state, the movable board 64 extended frontwards is pushed into the housing 2 by hand. When the movable board 64 has been pushed up to the original position, the lower end of the projection 61 is disengaged from the abutting part 66, sliding on the movable board 64 and drope down into the opening 65 due to pulling force of the spring 71 to stop the movable board 64. Thereby the projection 61 is returned to the original state.

The running toy shooting apparatus as utilized to shoot a running toy shaped in a motorcycle has been illustrated. The toy which can be shot by the shooting apparatuse of the present invention, however, may have any shape such as a car having three or four wheels, an airplane, a yacht, a boat, etc. provided it has a flywheel as drive wheel. Although the energizing means disclosed comprises a gear train including a reel in the embodiment, it may also comprise a straight flexible rack belt engagable with a pinion rotating as one body with the flywheel.

As illustrated above, according to the present invention, a running toy having a flywheel as drive wheel can be shot without idle run and with a high initial velocity in a desired direction constantly. Because of the stable start with a high initial velocity, when a projection is disposed on the runway, the running toy can be caused to jump up, somersaulted and run again.

What is claimed is:

1. A running toy shooting apparatus for shooting a running toy having flywheel as a drive wheel and a pinion rotating as one body with said flywheel, which are supported freely with an axle, said shooting apparatus comprising:

a holder means adapted to hold said running toy axle, said holder means being movable between a starting position and a shooting position located forward of said starting position, a stopper means for retaining said running toy axle and said holder means in a stationary state at said starting position, said stopper means and said holder means adapted to hold said running toy axle such that said flywheel is lifted from engagement with any surface while in said starting position, an energizing means for energizing said flywheel by engaging with and rotating said pinion while said flywheel is lifted from engagement with any surface and said running toy is stationary at said starting position, a manual release means for disengaging said stopper means, a runway extending forwardly from said shooting position, and a drive means for driving said holder means and said running toy up to said shooting position upon activation of said release means, to propel said running toy onto said runway with said flywheel engaged on said runway, and thereby propel said running toy from said shooting apparatus.

2. The running toy shooting apparatus according to claim 1 wherein said stopper means has at least one hook for engaging said running toy axle at said starting position, and said release means comprises an manually operable member adapted to move said hook in a direction sufficient to release said running toy axle.

3. The running toy shooting apparatus according to claim 1 or 2, wherein said energizing means comprises a gear train including a movable gear which can move between a first position where said movable gear is engaged with said pinion and a second position apart from said pinion, a spring for pulling said movable gear towards said second position, a drive gear engaging with said movable gear, and a reel rotatable with said drive gear, which is constituted so as to move said movable gear up to said first position to energize said flywheel by pulling a string wound around said reel to rotate said reel.

4. The running toy shooting apparatus according to claim 1, wherein an extendible projection is disposed within said shooting position and said runway and adapted to be optionally extended to a position where said flywheel of the running toy will hit said projection.

5. A running toy and shooting apparatus therefor comprising a running toy having flywheel as a drive wheel and a pinion rotating as one body with said flywheel, said flywheel and pinion rotatably secured at an axle of said running toy, and a shooting apparatus copmprising a holder means adapted to hold said running toy axle, said holder means being movable between a starting position and a shooting position located forward of said starting position, a stopper means for retaining said running toy axle and said holder means in a stationary state at said starting position, said stopper means and said holder means adapted to hold said running toy axle such that said flywheel is lifted from engagement with any surface while in said starting position, an energizing means for energizing said flywheel by engaging with and rotating said pinion and then disengaging said pinion, all while said flywheel is lifted from engagement with any surface and said running toy is stationary at said starting position, a manual release means for disengaging said stopper means, a runway extending forwardly from said shooting position, and a drive means for driving said holder means and said running toy up to said shooting position upon activation of said release means, to propel said running toy onto said runway with said flywheel engaged on said runway, and thereby propel said running toy from said shooting apparatus.

6. The running toy and shooting apparatus according to claim 5 wherein said energizing means comprises a gear train including a movable gear which can move between a first position where said movable gear is engaged with said pinion and a second position apart from said pinion, a spring for pulling said movable gear towards said second position, a drive gear engaging with said movable gear, and reel rotatable with said drive gear, which is constituted so as to move said movable gear up to said first position to energize said flywheel by pulling a string wound around said reel to rotate said reel.

7. The running toy and shooting apparatus according to claim 5 wherein an extendible projection is disposed within said shooting position and said runway and adapted to be optionally extended to a position where said flywheel of the running toy will hit said projection.

8. The running toy and shooting apparatus according to claim 5 wherein said stopper means has at least one hook for engaging said running toy axle at said starting position, and said release means comprises an manually operable member adapted to move said hook in a direction sufficient to release said running toy axle.

* * * * *